United States Patent [19]

Ostergaard

[11] 4,071,004

[45] Jan. 31, 1978

[54] ELECTRO-STATIC FUEL MIXTURE SYSTEM

[76] Inventor: Neil A. Ostergaard, 3830 S. 43rd St., Apt. 10, Milwaukee, Wis. 53220

[21] Appl. No.: 647,638

[22] Filed: Jan. 8, 1976

[51] Int. Cl.[2] ..... F02M 27/04

[52] U.S. Cl. ..... 123/119 E

[58] Field of Search ..... 123/119 E

[56] References Cited

U.S. PATENT DOCUMENTS

| | | | |
|---|---|---|---|
| 1,333,838 | 3/1920 | Csanyi | 123/119 E |
| 2,839,037 | 6/1958 | McKeever | 123/119 E |
| 2,999,485 | 9/1961 | Lundy | 123/119 E |
| 3,476,095 | 11/1969 | De Laubarede | 123/119 E |
| 3,682,608 | 8/1972 | Hicks | 123/119 E |
| 3,753,304 | 8/1973 | Hughes | 123/119 E |
| 3,761,062 | 9/1973 | King | 123/119 E |
| 3,955,548 | 5/1976 | Thomas | 123/119 E |
| 3,963,408 | 6/1976 | Youngberg | 123/119 E |
| 3,980,053 | 9/1976 | Horvath | 123/119 E |
| 3,989,017 | 11/1976 | Reece | 123/119 E |

*Primary Examiner*—Charles J. Myhre
*Assistant Examiner*—David D. Reynolds
*Attorney, Agent, or Firm*—Clarence A. O'Brien; Harvey B. Jacobson

[57] ABSTRACT

The air and fuel induction passage of a combustion engine is provided with air filtering structure for filtering the air entering the induction passage and fuel inlet structure for admitting fuel into the induction passage downstream from the air filtering structure. A foraminous panel constructed of conductive material is insulatively supported from the air filtering structure and disposed for passage of at least substantially all of the air moving through the air filtering structure through the foraminous panel. The fuel inlet structure includes at least a portion thereof constructed of conductive material and a source of high voltage, low amperage current is electrically connected, to the foraminous panel on one side and to the conductive portion of the fuel inlet structure on the other side.

6 Claims, 2 Drawing Figures

Fig. 1
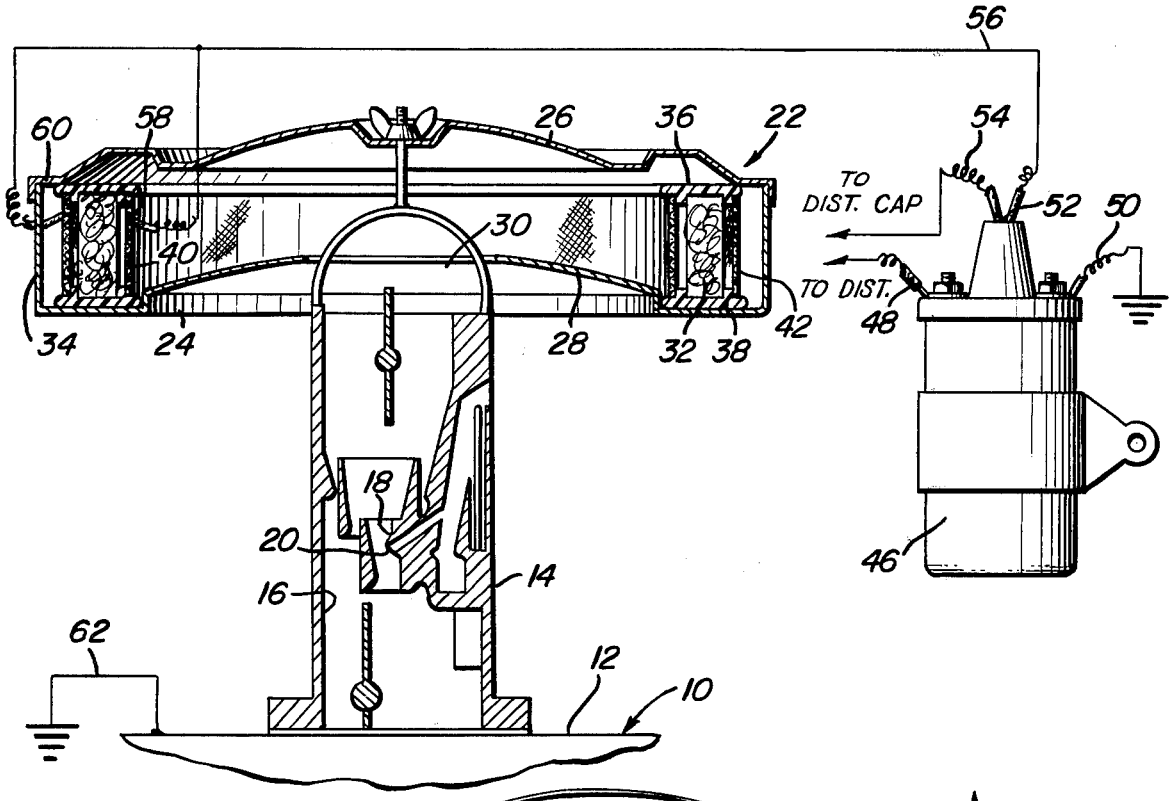
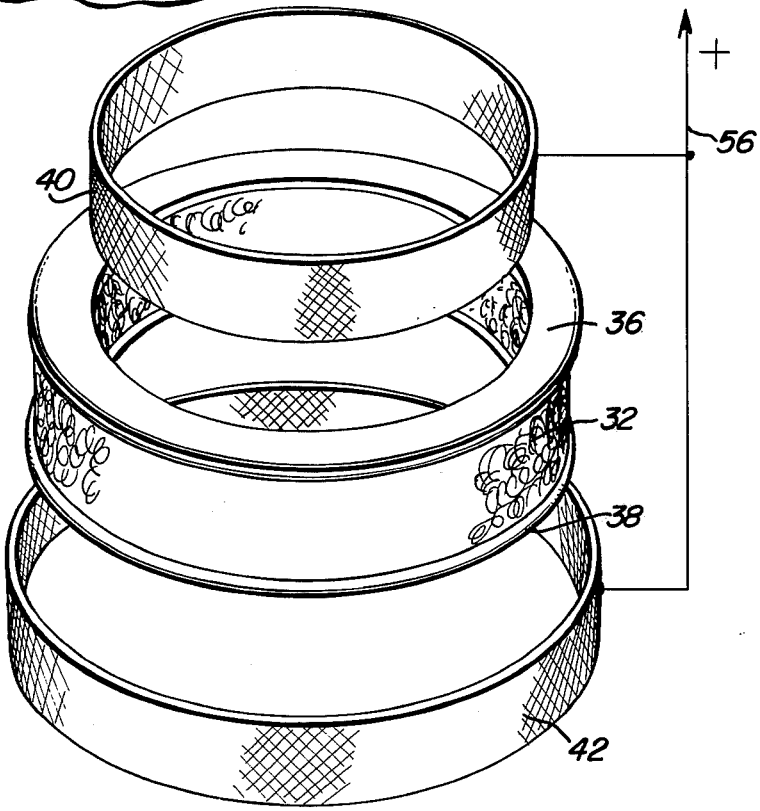
Fig. 2

ELECTRO-STATIC FUEL MIXTURE SYSTEM

BACKGROUND OF THE INVENTION

Recently there has been renewed attemps to increase the efficiency of internal combustion engines of the type which conventionally power motor vehicles in order that these engines may afford greater fuel mileage.

One method pursued in increasing the fuel economy of an internal combustion engine is to provide structure whereby the air entering the induction passage of the engine may be electrically charged, either negatively or positively, and the fuel discharged into the induction passage may be electrically charged either positively or negatively, respectively. By subjecting the air and fuel with opposite charges and thus ionizing the initial mixture of air and fuel, the tendency of the fuel to mix more thoroughly with the air is increased so as to result in a more readily combustible mixture.

The examples of apparatuses previously designed for this purpose are disclosed in U.S. Pat. Nos. 1,873,746, 2,839,037, 3,110,294, 3,266,783, 3,476,095, 3,537,829 and 3,761,062.

BRIEF DESCRIPTION OF THE INVENTION

Conventional automotive combustion engine air filtering systems utilize an annular air filtering body and the instant invention provides a pair of inner and outer axially short cylindrical foraminous panels for disposition immediately inwardly and outwardly of the annular air filtering body and with the foraminous panels insulatively supported from the air filter structure from which the annular air filtering body is supported. A source of secondary voltage from the ignition coil of the associated vehicle is electrically connected on one side to the inner and outer foraminous panels and the ground terminal of the primary circuit of the ignition coil is grounded to the engine and thus the carburetor thereof which admits fuels into the induction passage of the engine. In this manner, the foraminous panels are electrically connected to one side of the high voltage, low amperage current source and the associated carburetor comprises a ground for that source.

The main object of this invention is to provide a means for oppositely electrically charging the air and fuel passing through a conventional air and fuel charge forming device of a combustion engine.

A further object of this invention is to provide an apparatus in accordance with the preceding objects and which is adapted to utilize the secondary current output and a conventional ignition coil as the required source of high voltage, low amperage current.

A final object of this invention to be specifically enumerated herein is to provide an apparatus in accordance with the preceding objects and which will conform to conventional forms of manufacture, be of simple construction and easy to install so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a vertical sectional view taken substantially upon a center plane passing through the air and fuel induction system of a conventional automotive-type combustion engine and with the conductive foraminous air charging panels of the instant invention operatively connected to the secondary voltage of the ignition coil of the associated combustion engine; and FIG. 2 is an exploded perspective view of the air filtering body and inner and outer foraminous panels to be operatively associated therewith within the air filter housing.

DETAILED DESCRIPTION OF THE INVENTION

Referring now more specifically to the drawings, the numeral 10 generally designates a conventional form of internal combustion engine utilized to propel present day motor vehicles. The engine 10 includes an intake manifold 12 having a carburetor 14 mounted thereon. The intake manifold 12 and carburetor 14 are constructed of metal and are thus electrically conductive.

The carburetor 14 defines an air and fuel induction passage 16 extending therethrough and the lower outlet end of the passage 16 opens into the manifold 12 in a conventional manner. The carburetor 14 includes an electrically conductive portion 18 thereof through which liquid fuels such as gasoline is discharged as at 20 into the passage 16 and the inlet end of the passage 16 has an air filter assembly referred to in general by the reference numeral 22 operatively associated therewith. The air filter assembly 22 includes a circular housing 24 having vertically spaced top and bottom walls 26 and 28 and the bottom wall 28 has a central opening 30 formed therein from which air entering the air filter assembly 22 may pass into the inlet end of the passage 16. The air filter assembly 22 is provided with a conventional air filtering body 32 of annular configuration and sealingly supported between the top and bottom walls 26 and 28 adjacent the outer peripheral portion thereof. The housing 24 includes an outer peripheral cylindrical wall 34 spaced outwardly of the air filtering body 32 and extending between the top wall 26 and the bottom wall 28, the outer peripheral wall 34 having an air inlet opening (not shown) formed therethrough as is conventional.

The air filtering body 32 is conventionally supported between upper and resilient dielectric annular members 36 and 38 and the instant invention includes a pair of inner and outer foraminous axially short cylindrical panels 40 and 42 supported between corresponding inner and outer peripheral portions of the dielectric annular members 36 and 38 whereby the foraminous panels 40 and 42 are insulatively supported from the air filtering assembly 22, the panels 40 and 42 being constructed of conductive material.

The engine 10 includes an ignition system including a conventional ignition coil 46 electrically connected, on its primary side, to a suitable source (not shown) of electrical potential as at 48 and grounded as at 50. The source of electrical potential for the coil 46 comprises the conventional storage battery of the associated motor vehicle and the battery is electrically connected to the coil 46 through the conventional distributor of the engine 10.

The coil 46 includes a secondary current output 52 connected by a conductor 54 to the center electrode of the center of the cap of the aforementioned distributor and also by conductor 56 to the inner and outer panels 40 and 42 as at 58 and 60, respectively. The engine 10 is grounded as at 62 to a ground common with the ground 50. If desired the conductor 56 may be connected directly to the panel 42 at 60 and a second conductor may be used to electrically connect the panel 42 to panel 40.

Accordingly, the inner and outer panels 40 and 42 are electrically connected to a source of high voltage, low amperage current and the air passing through the air filter assembly 22 is forced to pass not only through the annular body 32 but also through the cylindrical foraminous panels 40 and 42 and is thereby electrically charged, at least to some degrees, by the panels 40 and 42. On the other hand, the carbaretor, and specifically the portion 18, is grounded as at 62 to the common ground for the coil 46. Accordingly, fuel being discharged as at 20 into the passage 16 is oppositely charged and more complete mixture of the liquid fuel discharged into the passage 16 with air passing through the air filter assembly 22 and subsequently through the passage 16 is increased due to ionization of the air and fuel, the air having attained one electrical charge and the fuel having attained the opposite electrical charge. The more efficient mixing of air and liquid fuel within the passage 16 results in more complete combustion of the air and fuel mixture within the engine 10 and thus results in increased fuel economy of the engine 10. If it is desired, the panels 40 and 42 may receive their electrical charge from an ignition type of vibrator coil in lieu of the coil 46. However, the loss of current by the electrical connection of the output 52 to the panels 40 and 42 is minimal and does not adversely affect the ignition system of the engine 10.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new as follows:

1. In combination with a combustion engine of the type including induction passage for air and fuel including air filtering means operatively associated with its inlet end and fuel inlet means for admitting fuel into said induction passage downstream from said air filtering means intermediate the inlet end of the induction passage and the outlet end thereof opening into said engine, foraminous panel means constructed of conductive material insulatively supported from said air filtering means and disposed for passage of at least substantially all of the air passing through said air filtering means through said foraminous panel means, said fuel inlet means including at least a fuel discharging portion thereof constructed of conductive material, and high voltage, low amperage current source means electrically connected to said foraminous panel means and grounded relative to said fuel inlet means fuel discharging portion.

2. The combination of claim 1 wherein said current source means comprises the secondary voltage source of an induction coil having its primary side electrically connected to a suitable source of electrical potential.

3. The combination of claim 1 wherein said combustion engine includes an ignition system to which secondary spark voltage is supplied from said secondary voltage source.

4. The combination of claim 3 wherein said air filtering means includes means defining an annular air intake passage radially of which air passing through said air filtering means passes, said air filtering means includes an annular air filtering body concentrically disposed in said air intake passage, said foraminous panel means includes an axially short cylindrical panel concentrically disposed relative to said annular air filtering body.

5. The combination of claim 4 wherein said cylindrical panel is disposed outwardly of said air filtering body.

6. The combination of claim 4 wherein said foraminous panel means includes a second axially short cylindrical panel concentrically disposed relative to said annular body, said cylindrical panels being disposed outwardly and inwardly of said air filtering body.

* * * * *